US007764298B2

(12) United States Patent
Adachi

(10) Patent No.: US 7,764,298 B2
(45) Date of Patent: Jul. 27, 2010

(54) ION GENERATING ELEMENT, WITH INDEPENDENT HEATING ELECTRODE, AND CHARGING DEVICE AND IMAGE FORMING APPARATUS USING ION GENERATING ELEMENT

(75) Inventor: Katsumi Adachi, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 32 days.

(21) Appl. No.: 12/163,776

(22) Filed: Jun. 27, 2008

(65) Prior Publication Data

US 2009/0001280 A1 Jan. 1, 2009

(30) Foreign Application Priority Data

Jun. 29, 2007 (JP) ..... 2007-173380

(51) Int. Cl.
*B41J 2/415* (2006.01)
*G03G 15/02* (2006.01)

(52) U.S. Cl. ..... 347/123; 399/168

(58) Field of Classification Search ..... 399/50, 399/168, 115, 89; 347/123, 127–128; 250/281, 250/285

See application file for complete search history.

(56) References Cited

U.S. PATENT DOCUMENTS

| | | | | |
|---|---|---|---|---|
| 4,783,716 | A | 11/1988 | Nagase et al. | |
| 5,138,348 | A * | 8/1992 | Hosaka et al. | 347/128 |
| 5,367,366 | A | 11/1994 | Kido et al. | |
| 5,404,157 | A | 4/1995 | Hosaka et al. | |
| 5,864,737 | A | 1/1999 | Obu et al. | |
| 5,983,060 | A | 11/1999 | Namekata et al. | |
| 2002/0102108 | A1 | 8/2002 | Adachi et al. | |
| 2007/0059000 | A1 | 3/2007 | Shibuya | |
| 2007/0085041 | A1 * | 4/2007 | Hisanobu | 250/504 R |

FOREIGN PATENT DOCUMENTS

| | | | |
|---|---|---|---|
| JP | 61-36782 | | 2/1986 |
| JP | 62-141570 | | 6/1987 |
| JP | 8-160711 | | 6/1996 |
| JP | 10-198124 | A | 7/1998 |
| JP | 10198124 | A * | 7/1998 |
| JP | 11-194581 | | 7/1999 |
| JP | 2001-257054 | A | 9/2001 |
| JP | 2002-237368 | | 8/2002 |

(Continued)

OTHER PUBLICATIONS

Machine English Translation of JP10-198124.*

(Continued)

*Primary Examiner*—David M Gray
*Assistant Examiner*—Billy J Lactaoen
(74) *Attorney, Agent, or Firm*—Nixon & Vanderhye P.C.

(57) ABSTRACT

In an ion generating element according to the present invention, a discharge electrode and an inductive electrode are provided to face each other with a dielectric body therebetween, and a heater electrode for producing heat with Joule heat generated by electrification and the inductive electrode are provided independently on the same surface of the dielectric body. Further, the heater electrode and the inductive electrode are connected and positioned such that a heater current does not flow into the inductive electrode. Thereby, it is possible to appropriately set a size or a shape of the inductive electrode according to a condition at low costs, allowing stable and effective discharge.

20 Claims, 6 Drawing Sheets

FOREIGN PATENT DOCUMENTS

| | | | |
|---|---|---|---|
| JP | 2002237368 A | * | 8/2002 |
| JP | 2003-249327 | | 5/2003 |
| JP | 2003-326756 | | 11/2003 |
| JP | 2004-69860 | | 3/2004 |
| JP | 2004-157447 | | 6/2004 |
| JP | 2006-47641 A | | 2/2006 |

OTHER PUBLICATIONS

Machine English Translation of JP2002-237368.*

U.S. Appl. No. 12/216,054 filed Jun. 27, 2008, entitled "Changing Device, Image Forming Apparatus, Control Method of Charging Device, Control Program, Computer-Readable Storage Medium Recording Control Program".

* cited by examiner

ION GENERATING ELEMENT, WITH INDEPENDENT HEATING ELECTRODE, AND CHARGING DEVICE AND IMAGE FORMING APPARATUS USING ION GENERATING ELEMENT

This Nonprovisional application claims priority under 35 U.S.C. §119(a) on Patent Application No. 173380/2007 filed in Japan on Jun. 29, 2007, the entire contents of which are hereby incorporated by reference.

FIELD OF THE INVENTION

The present invention relates to: an ion generating element, included in an image forming apparatus such as a copying machine, a printer, and a facsimile, for use in an image forming process in which an electrostatic latent image formed on an image bearing member is developed by toner and then transferred onto and fixed on a print medium; a charging device including the ion generating element; and an image forming apparatus including the ion generating element.

More specifically, the present invention relates to: an ion generating element, in which a discharge electrode and an inductive electrode are positioned on front and back sides of a dielectric body, for applying a high alternating voltage across the electrodes to generate creeping discharge and to take out ions having a desired polarity so that (i) a charge receiving material (such as a photoreceptor) is charged, and that (ii) a toner image on an image bearing member (such as the photoreceptor and an intermediate transfer body) is charged before it is transferred to a transfer receiving body (such as the intermediate transfer body and recording paper); and to a charging device including the ion generating element. The present invention also relates to an image forming apparatus including the charging device.

BACKGROUND OF THE INVENTION

Conventionally, in an image forming apparatus that employs an electrophotographic printing method, a charging device that employs a corona discharge system has been often used in, for example, a charging device for charging a photoreceptor, a transfer device for electrostatically transferring, to recording paper or the like, a toner image which is formed on the photoreceptor or the like, and a separation device for separating the recording paper or the like which electrostatically comes into contact with the photoreceptor or the like.

Such a charging device employing the corona discharge system generally includes a shield case having an opening section that faces a charge receiving material such as the photoreceptor and the recording paper, and a discharge electrode of a line or saw-tooth shape which discharge electrode is provided in a tensioned state in the shield case. Examples of this charging device include (a) a corotron that (i) applies a high voltage to the discharge electrode so as to generate corona discharge and, thereby, (ii) uniformly charges a charge receiving material, and (b) a scorotron that (i) applies a desired voltage to a grid electrode provided between a discharge electrode and a charge receiving material and, thereby, (ii) uniformly charges the charge receiving material, which scorotron is disclosed in Japanese Unexamined Patent Publication No. 11946/1994 (Tokukaihei 6-11946) (published on Jan. 21, 1994) (Patent Document 1).

This charging device employing the corona discharge system is used in a pre-transfer charging device for charging a toner image that has not been transferred yet to a transfer medium such as an intermediate transfer body, the recording paper, or the like. Examples of such a charging device are disclosed in Japanese Unexamined Patent Publication No. 274892/1998 (Tokukaihei 10-274892) (published on Oct. 13, 1998) (Patent Document 2) and Japanese Unexamined Patent Publication No. 69860/2004 (Tokukai 2004-69860) (published on Mar. 4, 2004) (Patent Document 3). According to techniques as disclosed in Patent Documents 2 and 3, even if a charge amount is not uniform in the toner image formed on an image bearing member, the charge amount of the toner image is uniformized before the toner image is transferred. Therefore, it becomes possible to suppress a decrease in a transfer margin at the time of transferring a toner image, and also to stably transfer the toner image to a transfer medium.

However, the conventional charging device described above has a plurality of problems. First, the charging device requires not only the discharge electrode but also the shield case, the grid electrode, and the like. Further, it is necessary to ensure a constant distance (10 mm) between the discharge electrode and the charge receiving material. As a result, a large space becomes necessary for providing the charging device. Generally, a developing device, a first transfer device, and the like are provided around a first transfer section, and the photoreceptor, a second transfer device, and the like are provided in front of a second transfer section. Accordingly, a space for the pre-transfer charging device is small. Therefore, in the conventional charging device employing the corona discharge system, it is difficult to make a layout.

Secondly, the conventional charging device employing the corona discharge system generates a large amount of discharge products such as ozone ($O_3$) and nitrogen oxide (NOx). Generation of a large amount of ozone causes (i) ozone smell, (ii) a harmful influence on a human body, (iii) deterioration of members due to strong oxidation power, and the like. Further, when nitrogen oxide is generated, nitrogen oxide as ammonium salt (ammonium nitrate) adheres to the photoreceptor. This causes a defect in an image. Especially an organic photoreceptor (OPC) that is commonly used tends to cause a defect in an image, for example, a white spot or an image deletion because of ozone, NOx or the like.

In view of uniformity of a charge amount of a toner image that has not been transferred yet, a color image forming apparatus, which employs an intermediate transfer system and includes a plurality of transfer sections, preferably has an arrangement in which pre-transfer charging device is provided upstream with respect to each of the transfer sections (a plurality of the first transfer sections, and a second transfer section). However, this is practically difficult in consideration of generation amounts of ozone and NOx.

Furthermore, for the purpose of eliminating ozone, in recent years, a charging device employing a contact electrification system has been used as a charging device for charging the photoreceptor itself. In the contact electrification system, a conductive roller or a conductive brush carries out contact electrification. However, when employing the contact electrification system, it is difficult to carry out charging without damaging the toner image. Accordingly, the corona discharge system which is a non-contact system is used for the pre-transfer charging device. However, in a case where the pre-transfer charging device employing the conventional corona discharge system is provided to the image forming apparatus using the contact electrification system, a characteristic of being ozone free cannot be achieved.

As a technique for reducing a generation amount of ozone, for example, Japanese Unexamined Patent Publication No. 160711/1996 (Tokukaihei 8-160711) (published on Jun. 21, 1996) (Patent Document 4) discloses a charging device including: a large number of discharge electrodes arranged at a substantially equal pitch in a predetermined axial direction; a high voltage power source for applying, to the discharge electrodes, a voltage equal to or higher than a voltage for starting discharge; a resistor provided between an output electrode of the high voltage power source and the discharge electrodes; a grid electrode provided in the vicinity of the discharge electrodes and between the discharge electrodes and the charge receiving material; and a grid power source for applying a grid voltage to the grid electrode. This charging device reduces a generation amount of ozone, by having an arrangement in which a gap between the discharge electrodes and the grid electrode is set to be equal to or less than 4 mm so as to reduce a discharge current.

According to the technique disclosed in Patent Document 4, a generation amount of ozone can be reduced by reduction in the discharge current. However, because the reduction of generation of ozone is not sufficient, approximately 1.0 ppm of ozone is still generated. Further, there is another problem such that discharge may become unstable due to adherence of discharge products, toner, paper powder, or the like to the discharge electrode, or abrasion/deterioration of a tip of the discharge electrode due to discharge energy. Furthermore, a shape of the discharge electrode makes it difficult to clean off the discharge products, the toner, or the paper powder from the discharge electrode.

Moreover, a narrow gap between the discharge electrode and the charge receiving material easily causes non-uniformity of electrification in a longitudinal direction (a direction of the pitch of the discharge electrodes) due to the pitch of the plurality of the discharge electrodes. Here, a shorter pitch of the discharge electrodes may improve the non-uniformity of electrification. However, this increases the number of the discharge electrodes, thereby increasing production cost.

In view of the problems of the conventional charging device, for example, Japanese Unexamined Patent Publication No. 249327/2003 (Tokukai 2003-249327) (published on Sep. 5, 2003) (Patent Document 5) discloses a charging device including an ion generating element (a creeping discharge element) which is provided with a discharge electrode having pointed protrusions on a periphery of the discharge electrode and an inductive electrode in a manner such that the discharge electrode and the inductive electrode sandwich a dielectric body, and which generates ions according to application of a high alternating voltage across the discharge electrode and the inductive electrode (hereinafter, this charging system is referred to as a creeping discharge system). The charging device employing this creeping discharge system is small in size, because the charging device does not have a shield case, a grid electrode, and the like. Further, cleaning of the charging device is easy because a discharging surface of the charging device is flat. Therefore, the charging device also has an advantage in easiness of maintenance.

Here, discharge characteristics of the ion generating element (the creeping discharge element) tend to decline under a high humidity condition. In view of this problem, for example, Japanese Unexamined Patent Publication No. 157447/2004 (Tokukai 2004-157447) (published on Jun. 3, 2004) (Patent Document 6) and Japanese Unexamined Patent Publication No. 237368/2002 (Tokukai 2002-237368) (published on Aug. 23, 2002) (Patent Document 7) disclose a technique for improving the discharging characteristics by providing the ion generating element with a heater member and heating the element to remove absorption moisture. Especially, Patent Document 7 discloses a technique in which an inductive electrode is electrified to generate Joule heat, thereby doubling as a heater. With this technique disclosed in Patent Document 7, it becomes possible to make the ion generating element more compact and to reduce costs than with the technique of providing an additional heater element independently.

SUMMARY OF THE INVENTION

However, in a case where the inductive electrode doubles as a heater line, as described in Patent Document 7, there are problems described below.

For example, the conventional ion generating element (the creeping discharge element) illustrated in FIGS. 6 and 4(*b*) has an arrangement in which the inductive electrode of a line shape makes a loop so as to surround the discharge electrode, and different potentials are applied to respective ends of the inductive electrode, so that an electric current corresponding to resistance of the inductive electrode flows to generate Joule heat, with which the conventional ion generating element has the heater function. As the inductive electrode and the heater, there are wide variety of a desired shape and desired characteristics. A width and a position of the inductive electrode are closely related to an increase/decrease in a discharging amount or a generation amount of ozone. The width and the position should be set appropriately in consideration of conditions such as a thickness of a dielectric body layer and an applied voltage.

Meanwhile, a basic function of the heater is to heat the creeping discharge element up to a desired temperature by arbitrary input power supply. In a case where a heater power source has a control function over the input power supply, it is possible to control heating performance under little influence of a resistance value of the heater line, or of non-uniformity of the resistance value. However, the heater power source having a function for monitoring a voltage and a current and a function for variably controlling the voltage and the current may require a great increase in costs. Further, in order to reduce costs, it is more advantageous to use, as a power source voltage for the heater, a general-purpose power source voltage that is a driving voltage for various electric components, such as 5V, 12V and 24V, than to set an additional exclusive voltage as a power source voltage for the heater. In order to allow the heater to have desired heating performance in response to such a general-purpose voltage, it is necessary to set resistance of the heater to be within a desired range by determining a width, a length, and also a material of the heater line. However, as described above, the heater line doubles as the inductive electrode, so that when desired setting conditions of the heater line and the inductive electrode are different, it is difficult to successfully have both of the functions in response to the general-purpose voltage.

Moreover, there is another problem such that an inductive current may cause a power source line to have noise. When an alternating voltage is applied across the discharge electrode and the inductive electrode, an alternating current flows so as to charge/discharge a capacitor component that is formed by both of the electrodes and a dielectric body layer therebetween. FIG. 5(*a*) shows current waveforms at both of the electrodes, which current waveforms measured while a pulse voltage is applied. The system of measurement is illustrated in FIG. 5(*b*). When the voltage rises (in this case, when a negative voltage increases), a current for charging the capacitor component between the discharge electrode and the inductive electrode flows at once. As a result, spike-like current waveforms are observed, as shown in FIG. 5(*a*). These spike-like current waveforms include a discharge current. After the voltage has risen, the current hardly flows since it is charging the capacitor component. However, when the voltage falls, a reverse current is generated. Further, not illustrated though, in a case where a sine-wave voltage is applied, the waveform at each of the electrodes is a sine wave, and becomes a spike-like wave right before a peak of the voltage due to the discharge current. However, in a case where the sine-wave voltage is applied, current values vary in a small range and the maximum current value and spike-like current values that are generated by discharge are small. This alternating current is generated both at a discharge electrode side and an inductive electrode side. Here, in a case where the inductive electrode is connected with the heater line, the inductive current flows into a power source section, too. This could cause noise. Moreover, in a high humidity environment, the pulse wave has higher discharge efficiency than the sine wave. This is because, in the high-humidity environment, a potential difference between the discharge electrode and the dielectric body that is located around the discharge electrode becomes small because of absorption moisture therebetween. In a case where the sine-wave voltage is applied, a big potential difference hardly occurs depending on a time constant of surface resistance in the vicinity of the discharge electrode with respect to a rise time of the voltage, under a moisture absorption condition. Thereby, discharge is hardly generated. Meanwhile, in the case of the pulse wave, the applied voltage varies precipitously. Thereby, it is easy to have a state in which the potential difference between the discharge electrode and the dielectric body is large. Therefore, discharge is easily generated. However, in the case of the pulse wave, the inductive current has the spike-like shape. The values of the inductive current vary in a big range, so that there is a possibility of generation of noise.

On the other hand, in the high humidity environment, it is effective to reduce the absorption moisture by heating the discharge element with the heater. This makes it possible to discharge stably and effectively because of both the heater effect and the pulse wave effect. However, in a case where the pulse voltage is applied, the inductive current has the spike-like shape when the voltage rises and falls. Therefore, in a case where the inductive current having the spike-like shape flows in a heater power source line, this tends to cause damage to a power source section or generation of noise.

The present invention is made in view of the problems described above. An object of the present invention is to provide: an ion generating element, in which a size or a shape of an inductive electrode is set appropriately at low costs according to conditions, for discharging stably and effectively; a charging device; and an image forming apparatus.

In order to solve the foregoing problems, the ion generating element according to an aspect of the present invention is an ion generating element for generating ions resulting from creeping discharge caused by applying an alternating voltage across a discharge electrode and an inductive electrode, both of which are provided to face each other with a dielectric body therebetween, including a heater electrode for heating the ion generating element with Joule heat generated by electrification, the heater electrode and the inductive electrode provided independently on the same surface of the dielectric body, and the heater electrode and the inductive electrode being connected with each other and positioned such that a heater current does not flow into the inductive electrode.

With the arrangement, the heater electrode and the inductive electrode are provided independently, are connected with each other and positioned such that the heater current does not flow into the inductive electrode. Thus, a resistance value of the inductive electrode does not affect the heater electrode. This makes it possible to appropriately set the size or the shape of the inductive electrode, according to various conditions. Further, the heater electrode can heat the ion generating element, and decrease absorption moisture without an influence on discharge characteristics between the discharge electrode and the inductive electrode. Thereby, the ion generating element with the above arrangement can discharge stably and effectively. Furthermore, it is possible to adjust a width or a length of the heater electrode such that desired input power supply is provided at a voltage (such as 12V and 24V), which is also used for discharge for generating ions. Moreover, the heater electrode and the inductive electrode are provided on the same surface of the dielectric body, so that it is possible to form the ion generating element without an increase in a thickness of the dielectric body in a lamination direction and in a size of the ion generating element.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a view illustrating a modified example of the ion generating element illustrated in FIG. 1(*a*).

FIG. 1(*c*) is a view illustrating another modified example of the ion generating element illustrated in FIG. 1(*a*).

FIG. 3(*b*) is a side view of an ion generating element of the charging device according to the embodiment.

FIG. 4(*b*) is an elevational view of another conventional ion generating element as a comparative example.

FIG. 4(*c*) is an elevational view of the ion generating element of an example according to the present invention.

FIG. 5(*b*) is a view illustrating an arrangement of a system of measurement in the measurement of FIG. 5(*a*).

DESCRIPTION OF THE EMBODIMENTS

Figure 1A:
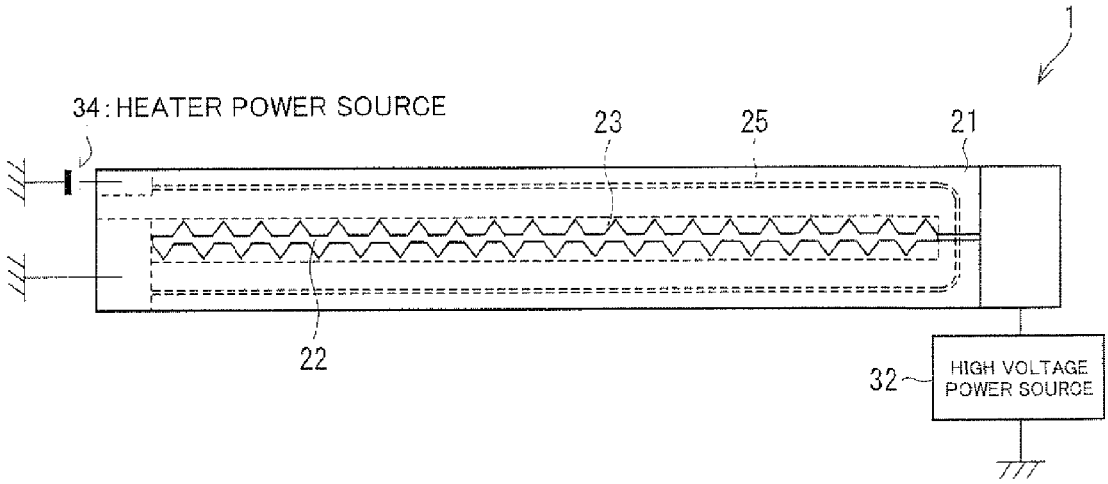
FIG. 1(*a*) is a view illustrating an embodiment of an ion generating element according to the present invention.
Figure 1B:
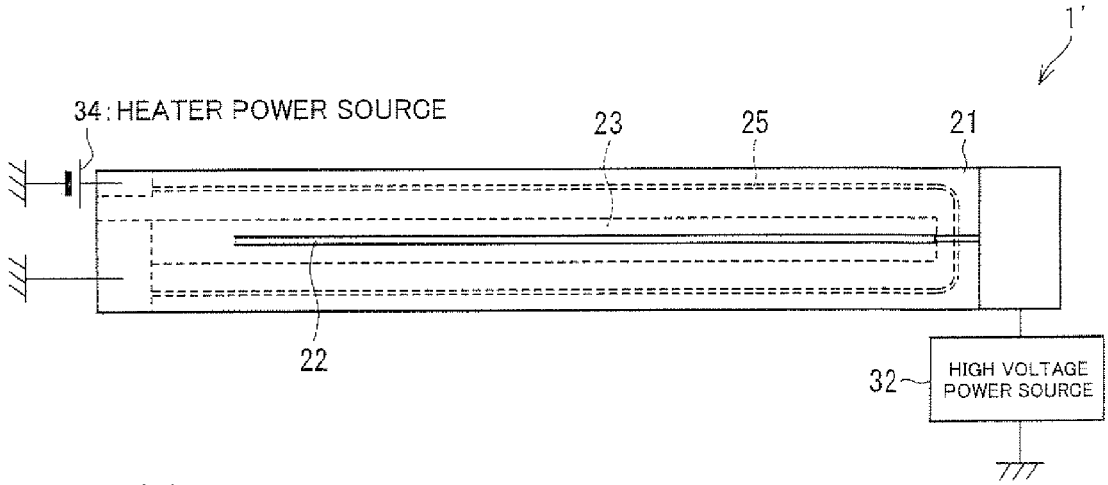
Figure 1C:
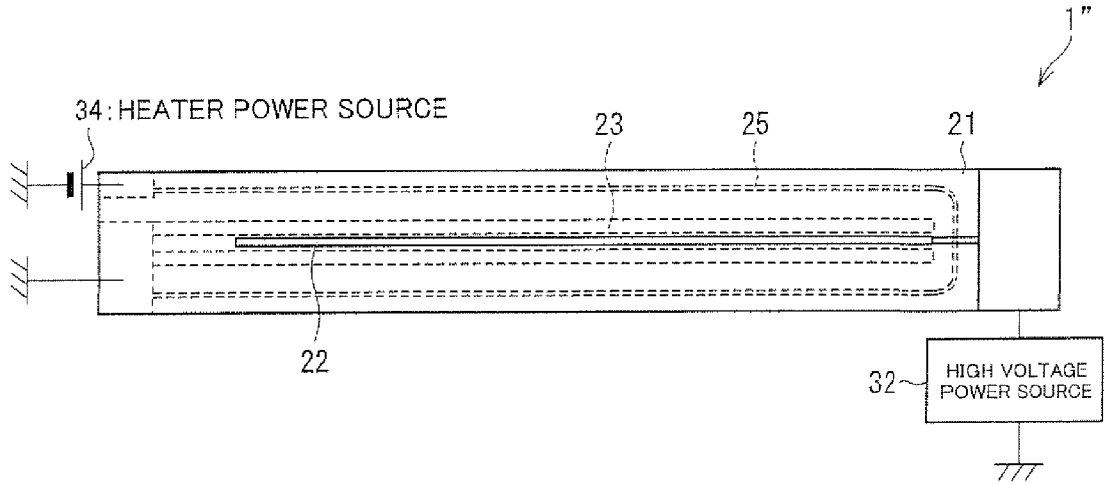

The following specifically explains one embodiment of a charging device according to the present invention, and an image forming apparatus including the charging device with reference to FIGS. 1(*a*) through 5(*b*). Note that the following embodiment is an example that specifically explains one or more pertinent aspects of the present invention, and does not limit the technical scope of the present invention.

Figure 2:
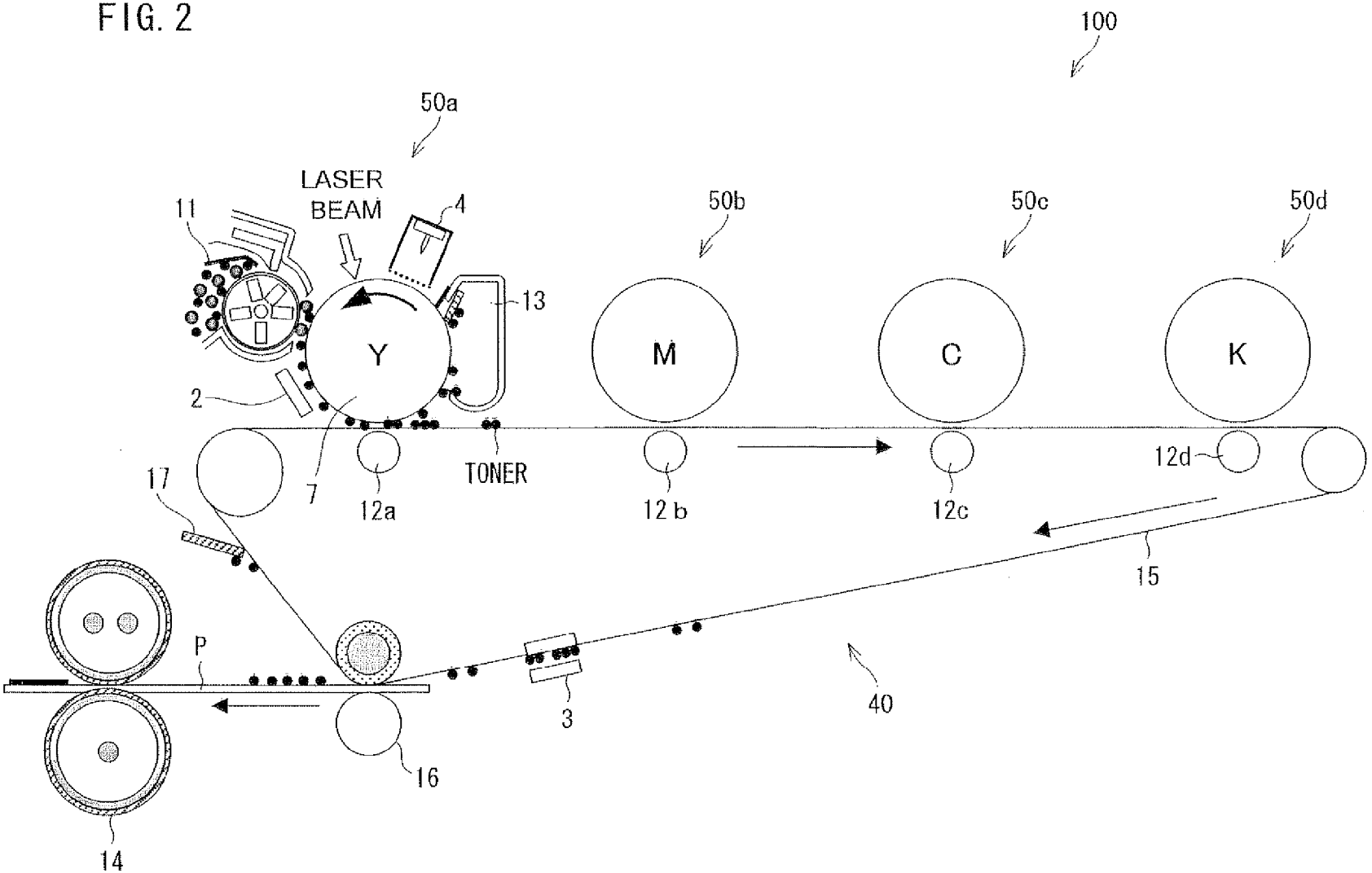
FIG. 2 is an explanatory view illustrating an arrangement of a main part of an image forming apparatus according to an embodiment of the present invention.

First, the following explains a whole arrangement of the image forming apparatus according to the present embodiment. FIG. 2 is a cross sectional view schematically illustrating an arrangement of an image forming apparatus 100 according to the present embodiment. This image forming apparatus 100 is a tandem type printer employing an intermediate transfer system, and can form a full color image.

As illustrated in FIG. 2, the image forming apparatus 100 includes visible image forming units 50*a* to 50*d* for four colors (C, M, Y, and K), a transfer unit 40, and a fixing device 14.

The transfer unit 40 includes an intermediate transfer belt 15 (an image bearing member), four first transfer devices 12*a* to 12*d* provided around the intermediate transfer belt 15, a second pre-transfer charging device 3, a second transfer device 16, and a transfer cleaning device 17.

Toner images of the colors visualized by the visible image forming units 50*a* to 50*d* are overlapped on and transferred to the intermediate transfer belt 15. The intermediate transfer belt 15 further transfers the transferred toner images to recording paper P. Specifically, the intermediate transfer belt 15 is a belt that has no end, and is suspended in a tensioned state by a pair of driving rollers and an idle roller. At the time of forming an image, conveyance driving is subjected to the intermediate transfer belt 15 under control at a predetermined peripheral velocity (in the present embodiment, in a range of 167 mm/s to 225 mm/s).

The first transfer devices 12*a* to 12*d* are provided to the visible image forming units 50*a* to 50*d*, respectively. The toner image is transferred to the intermediate transfer belt 15 by applying, to the first transfer devices 12*a* to 12*d*, a bias voltage whose polarity is opposite to that of the toner image formed on a surface of a photosensitive drum (an electrostatic latent image bearing member) 7. Each of the first transfer devices 12*a* to 12*d* is positioned so as to face corresponding one of the visible image forming units 50*a* to 50*d* via the intermediate transfer belt 15.

The second pre-transfer charging device 3 re-charges the toner image that has been overlapped on and transferred to the intermediate transfer belt 15. In the present embodiment, the second pre-transfer charging device 3 discharges ions so as to charge the toner image, which is explained later in detail.

The second transfer device 16 re-transfers, to the recording paper P, the toner image which has been transferred to the intermediate transfer belt 15. The second transfer device 16 is provided in touch with the intermediate transfer belt 15. The transfer cleaning device 17 cleans a surface of the intermediate transfer belt 15 after the toner image is re-transferred.

Around the intermediate transfer belt 15 of the transfer unit 40, the first transfer units 12*a* to 12*d*, the second pre-transfer charging device 3, the second transfer device 16, and the transfer cleaning device 17 are provided in this order from an upstream side in a carrying direction of the intermediate transfer belt 15.

The fixing device 14 is provided in a downstream side of the second transfer device 16 in a carrying direction of the recording paper P. The fixing device 14 fixes, to the recording paper P, the toner image which has been transferred onto the recording paper P by the second transfer device 16.

Further, the four visible image forming units 50*a* to 50*d* are provided in touch with the intermediate transfer belt 15 along the carrying direction of the intermediate transfer belt 15. The four visible image forming units 50*a* to 50*d* have the same arrangement except that different toner colors are used. The toner colors of the four visible image forming units 50*a* to 50*d* are yellow (Y), magenta (M), cyan (C), and black (K), respectively. The following description deals with only the visible image forming unit 50*a*, and explanations of the other visible image forming units 50*b* to 50*d* are omitted. Accordingly, FIG. 2 illustrates only members of the visible image forming unit 50*a*. However, the other visible image forming units 50*b* to 50*d* also include the same members as the visible image forming unit 50*a*.

The visible image forming unit 50*a* includes the photosensitive drum 7, a latent image charging device 4 that is provided in the vicinity of the photosensitive drum 7, a laser writing unit (not illustrated), a developing device 11, a first pre-transfer charging device 2, a cleaning device 13, and the like.

The latent image charging device 4 charges a surface of the photosensitive drum 7 to a predetermined electric potential. In the present embodiment, the latent image charging device 4 emits ions so as to charge the photosensitive drum 7. A detailed explanation of the latent image charging device 4 is given later.

According to image data received from an external device, the laser writing unit irradiates a laser beam on the photosensitive drum 7 (exposes the photosensitive drum 7 to the laser beam), and writes, by scanning a light image, an electrostatic latent image on the photosensitive drum 7 that has been uniformly charged.

The developing device 11 provides toner to the electrostatic latent image that is formed on the surface of the photosensitive drum 7, so as to form the toner image by developing the electrostatic latent image.

The first pre-transfer charging device 2 re-charges the toner image that is formed on the surface of the photosensitive drum 7, before the toner image is transferred. In the present embodiment, the first pre-transfer charging device 2 emits ions so as to charge the toner image. A detailed explanation of the first pre-transfer charging device 2 is given later.

The cleaning device 13 removes and collects residual toner that is left on the photosensitive drum 7, after the toner image is transferred to the intermediate transfer belt 15. This allows forming a new electrostatic latent image and a new toner image on the photosensitive drum 7.

Around the photosensitive drum 7 of the visible image forming unit 50*a*, the latent image charging device 4, the laser writing unit, the developing device 11, the first pre-transfer charging device 2, the first transfer device 12*a*, and the cleaning device 13 are provided in this order from an upstream side in a rotation direction of the photosensitive drum 7.

Next, the following explains an image forming operation of the image forming apparatus 100. An operation of the visible image forming unit is explained with reference to members (members having reference numerals) of the visible image forming unit 50*a*. The visible image forming units 50*b* to 50*d* operate in the same manner as the visible image forming unit 50*a*.

First, the image forming apparatus 100 acquires image data from an external device (not illustrated). Moreover, a driving unit (not illustrated) of the image forming apparatus 100 rotates the photosensitive drum 7 in a direction shown by an arrow illustrated in FIG. 2 at a predetermined velocity (in the present embodiment, in a range of 167 mm/s to 225 mm/s). Simultaneously, the latent image charging device 4 charges the surface of the photosensitive drum 7 to a predetermined electric potential.

Next, according to the acquired image data, the laser writing unit exposes the surface of the photosensitive drum 7, and writes, to the surface of the photosensitive drum 7, an electrostatic latent image corresponding to the image data. Then, the developing device 11 provides toner to the electrostatic latent image that is formed on the surface of the photosensitive drum 7. As a result, the toner adheres to the electrostatic latent image and a toner image is formed.

The first pre-transfer charging device 2 re-charges this toner image that is formed on the surface of the photosensitive drum 7. Then, the bias voltage whose polarity is opposite to that of the toner image formed on the surface of the photosensitive drum 7 is applied to the first transfer device 12*a*. This transfers (a first transfer), to the intermediate transfer belt 15, the toner image that is re-charged by the first pre-transfer charging device 2.

The visible image forming units 50*a* to 50*d* perform the aforementioned operation in turn so that the toner images of four colors Y, M, C, and K are overlapped on the intermediate transfer belt 15 in turn.

The overlapped toner images are carried to the second pre-transfer charging device 3 by the intermediate transfer belt 15. Then, the second pre-transfer charging device 3 re-charges thus carried toner images. Subsequently, the intermediate transfer belt 15 that bears the re-charged toner images is pressed against the recording paper P, which is fed from a paper feeding unit (not illustrated), by the second transfer device 16. Moreover, a voltage whose polarity is opposite to that of toner charge is applied to the intermediate transfer belt 15. As a result, the toner images are transferred to the recording paper P (a second transfer).

Then, the fixing device 14 fixes the toner image to the recording paper P. The recording paper P on which the image has been recorded is ejected to a paper output unit (not illustrated). After the transfer described above, residual toner left on the photosensitive drum 7 is removed and collected by the cleaning device 13. Further, residual toner left on the intermediate transfer belt 15 is removed and collected by the transfer cleaning device 17. This operation described above allows the image forming apparatus 100 to appropriately perform printing on the recording paper P.

Next, an arrangement of the pre-transfer charging device is explained in detail. The first pre-transfer charging device 2, the latent image charging device 4, and the second pre-transfer charging device 3 that are mentioned above are the same other than that the first pre-transfer charging device 2, the latent image charging device 4, and the second pre-transfer charging device 3 are provided in different positions, respectively. In the latent image charging device 4, a grid electrode for controlling an electric potential of charging may be provided between an ion generating element (a creeping discharge element) 1 explained below and the photosensitive drum 7. A position of this grid electrode is preferably approximately 1 mm away from the photosensitive drum 7, and approximately 2 mm to 10 mm away from the ion generating element 1. The following explains the second pre-transfer charging device 3 in detail, but detailed explanations of the first pre-transfer charging device 2 and the latent image charging device 4 are omitted.

Figure 3A:
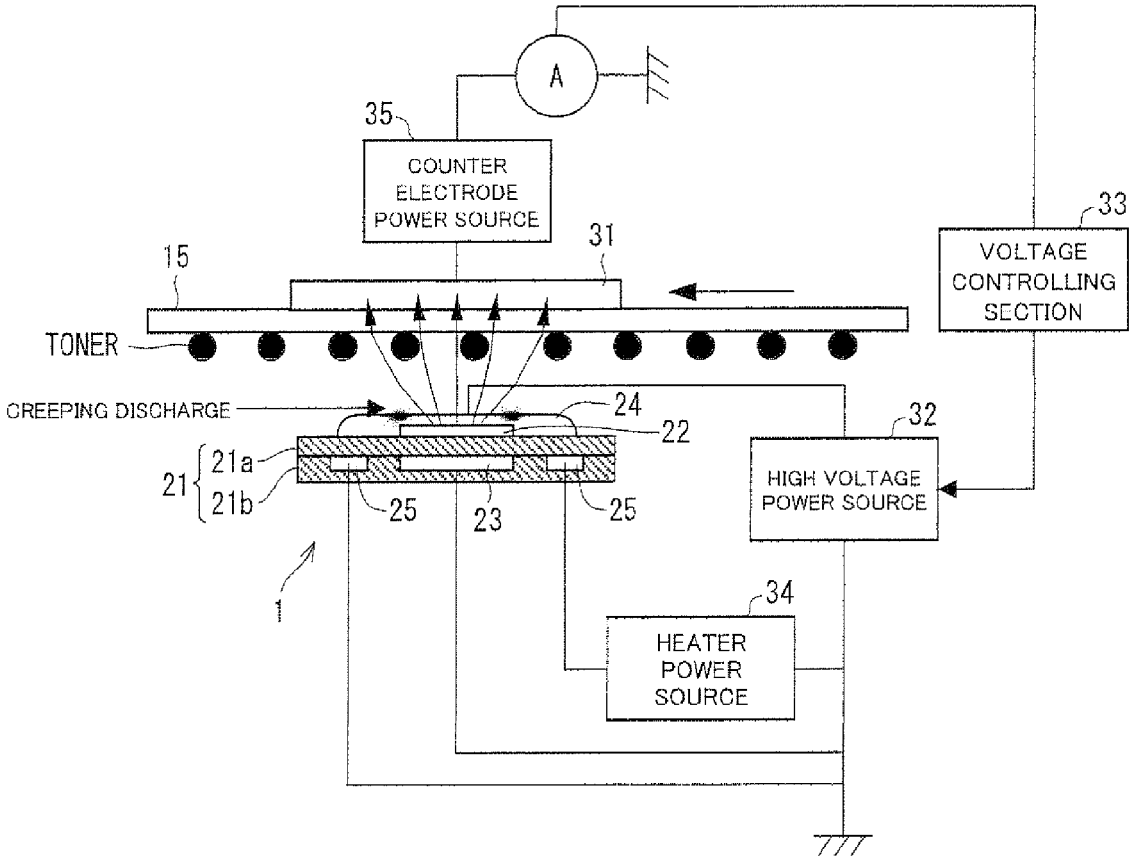
FIG. 3(*a*) is a view illustrating an arrangement of a charging device according to an embodiment of the present invention.
Figure 3B:
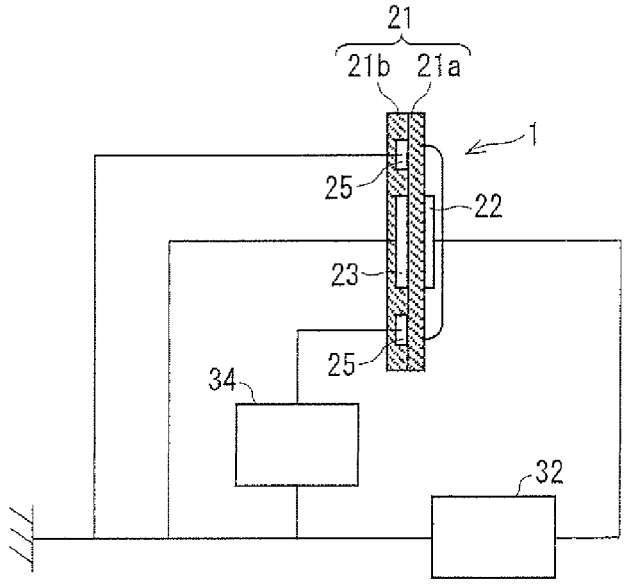

FIG. 3(*a*) is a block diagram of the second pre-transfer charging device 3 positioned in the vicinity of the intermediate transfer belt 15, and FIG. 3(*b*) is a side view of the ion generating element 1 of the second pre-transfer charging device 3, and FIG. 1(*a*) is an elevational view of the ion generating element 1 of the second pre-transfer charging device 3. Further, ion generating elements 1' and 1" illustrated in FIGS. 1(*b*) and 1(*c*), respectively, are modified examples of the ion generating element 1 illustrated in FIG. 1(*a*).

As illustrated in FIG. 3(*a*), the second pre-transfer charging device 3 includes the ion generating element 1, a counter electrode 31, a high voltage power source 32, and a voltage controlling section (voltage control means) 33.

The ion generating element 1, as illustrated in FIGS. 3(*a*) and 3(*b*), includes a dielectric body 21, a discharge electrode 22, an inductive electrode 23, and a coating layer (protective layer) 24. The ion generating element 1 generates ions by discharge due to an electric potential difference between the discharge electrode 22 and the inductive electrode 23 (corona discharge that is produced in the vicinity of the discharge electrode 22 in a direction along a surface of the dielectric body 21).

The dielectric body 21 is arranged as a flat plate that is made by bonding an upper dielectric body 21*a* and a lower dielectric body 21*b* that are substantially rectangular. When the dielectric body 21 is made of an organic material, a preferable material of the dielectric body 21 is a material that is excellent in oxidation resistance. For example, resin such as polyimide or glass epoxy may be used as the material. When an inorganic material is selected as a material of the dielectric body 21, a mica laminate material, alumina, glass-ceramics, forsterite, and ceramic such as steatite may be used as the material. In terms of corrosion resistance, an inorganic material is more preferable as the material of the dielectric body 21. Further, in terms of formability, easiness in electrode formation later explained, low moisture resistance, or the like, ceramic is preferably used in formation of the dielectric body 21. Moreover, it is desirable that an insulation resistance between the discharge electrode 22 and the inductive electrode 23 is uniform. Accordingly, the less a density inside the material of the dielectric body 21 varies and the more uniform an insulation ratio of the dielectric body 21 becomes, the more preferable the dielectric body 21 becomes. A preferable thickness of the dielectric body 21 is 50 μm to 250 μm. However, the thickness is not limited to this value.

The discharge electrode 22 is formed integrally with the dielectric body 21 on a surface of the dielectric body 21 (the upper dielectric body 21*a*). A material of the discharge electrode 22 is not specifically limited as long as the material is electrically conductive like, for example, tungsten, silver, or stainless steel. However, the material must not cause deformation such as meltdown or scattering due to discharge. It is preferable that the discharge electrode 22 has a uniform depth from a surface of the dielectric body 21 (in a case where the discharge electrode 22 is provided toward the inductive electrode 23 from the surface of the dielectric body 21) or a uniform thickness from the surface of the dielectric body 21 (in a case where the discharge electrode 22 is provided so as to protrude from the surface of the dielectric body 21). In the present embodiment, tungsten or stainless steel is used as the materials of the discharge electrode 22.

A shape of the discharge electrode 22 may be any shape as long as the shape extends evenly in a direction orthogonal with respect to a direction in which the intermediate transfer belt 15 moves. However, it is more preferable to have a shape that easily causes electric field concentration between the discharge electrode 22 and the inductive electrode 23, if possible. This is because such a shape allows discharge between the discharge electrode 22 and the inductive electrode 23 to be produced even in a case where a low voltage is applied between the discharge electrode 22 and the inductive electrode 23. In the present embodiment, the shape of the discharge electrode 22 has a comb-tooth shape as illustrated in FIG. 1(*a*) so that discharge is easily produced. In the present embodiment, the discharge electrode 22 has a comb-tooth shape, however, a rectangular shape is also applicable as in arrangements illustrated in FIGS. 1(*b*) and 1(*c*), and an arrangement of a later-mentioned example illustrated in FIG. 4(*c*).

The inductive electrode 23 is formed inside the dielectric body 21 (between the upper dielectric body 21*a* and the lower dielectric body 21*b*) and provided so as to be opposed to the discharge electrode 22. This is because it is preferable that the insulation resistance between the discharge electrode 22 and the inductive electrode 23 is uniform and the discharge electrode 22 and the inductive electrode 23 are provided in parallel to each other. This arrangement makes it possible to have a constant distance between the discharge electrode 22 and the inductive electrode 23 (hereinafter referred to as a distance between electrodes). Accordingly, a discharge state between the discharge electrode 22 and the inductive electrode 23 becomes stable and ions can be preferably generated. In this arrangement, the discharge electrode 22 and the inductive electrode 23 are provided to sandwich the upper dielectric body 21*a* and to be opposed to each other. Note that there is no problem in providing the dielectric body 21 as one layer and the inductive electrode 23 on a back surface of the dielectric body 21. However, this case requires ensuring a sufficient creeping distance with respect to an applied voltage or coating the discharge electrode 22 and the inductive electrode 23 with insulating coating layers (protective layers), for preventing the discharge electrode 22 and the inductive electrode 23 from leaking via the surface of the dielectric body.

As with the discharge electrode 22, a material of the inductive electrode 23 is not specifically limited as long as the material is electrically conductive like, for example, tungsten, silver, or stainless steel. The present embodiment employs tungsten or stainless steel as the material of the inductive electrode 23. The inductive electrode 23 may be a plane electrode as illustrated in FIGS. 1(*a*) and 1(*b*), or a line-shaped electrode, as illustrated in FIG. 1(*c*), provided parallel to the discharge electrode 22 in a longitudinal direction of the discharge electrode 22 such that the discharge electrode 22 is positioned between the line-shaped electrodes. One end of the inductive electrode 23 is connected to a ground potential (Ground) by a ground connecting terminal.

The heater electrode 25 is provided inside the dielectric body 21 (between the upper dielectric body 21*a* and the lower dielectric body 21*b*) separately from the inductive electrode 23, and has a line shape. The heater electrode 25 is wired along near a periphery of the dielectric body 21 so as to surround the inductive electrode 23. One end of the heater electrode 25 is provided to a heater power source 34, and the other end is connected to the ground potential. The heater power source 34 applies a predetermined voltage (12V in the present embodiment) to the heater electrode 25 so that the heater electrode 25 generates heat by Joule heat. By causing the heater electrode 25 to generate heat, a temperature of the dielectric body 21 rises (to approximately 60° C. in the present embodiment). This can suppress moisture absorption of the dielectric body 21 and makes it possible to stably generate ions in a high humidity environment. When the dielectric body 21 is made of ceramic, the dielectric body 21 itself does not absorb moisture. However, when dew condensation occurs on a surface of the dielectric body 21, discharge characteristics deteriorate. Therefore, it is effective to prevent dew condensation or vanish dewdrops by causing the heater to generate heat.

Here, in the ion generating element 1 in accordance with the present embodiment, the heater electrode 25 and the inductive electrode 23 are provided independently on the same surface of the upper dielectric body 21*a* (an upper surface of the lower dielectric body 21*b*). The inductive electrode 23 and the heater electrode 25 are positioned in such a manner that the heater current does not flow into the inductive electrode 23. Due to this arrangement, a resistance value of the inductive electrode 23 does not affect the heater electrode 25. Thus, it is possible to appropriately set a size or a shape of the inductive electrode 23, according to various conditions. Further, without any influence on discharge characteristics between the discharge electrode 22 and the inductive electrode 23, the heater electrode 25 can heat the ion generating element 1 so as to decrease absorption moisture. Therefore, the ion generating element 1 can discharge stably and effectively. Furthermore, in a case where the heater electrode 25 uses a voltage (e.g. 12V and 24V) that is also used for discharge for generating ions, it is possible to adjust a width and a length of the heater electrode 25 so that the ion generating element 1 receives a desired input power supply for the heating.

Figure 4A:
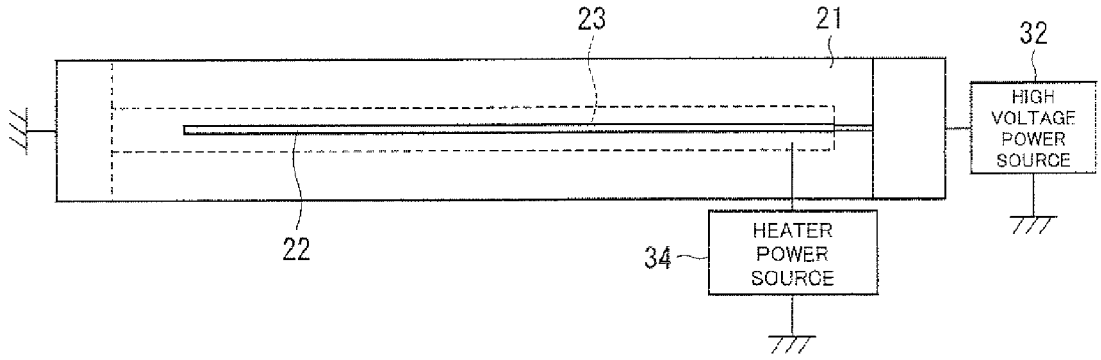
FIG. 4(*a*) is an elevational view of a conventional ion generating element as a comparative example.
Figure 4B:
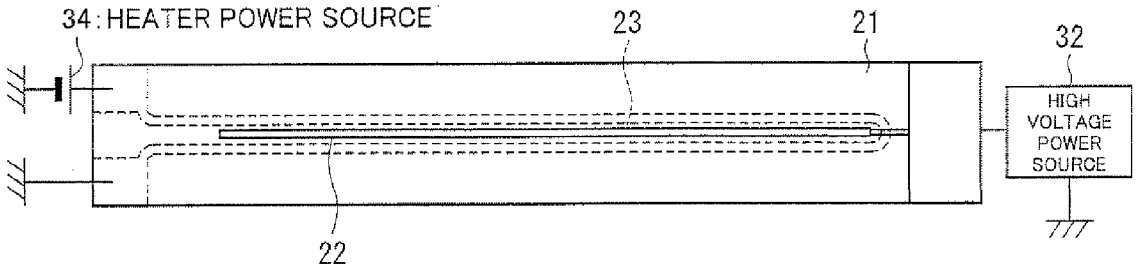
Figure 4C:
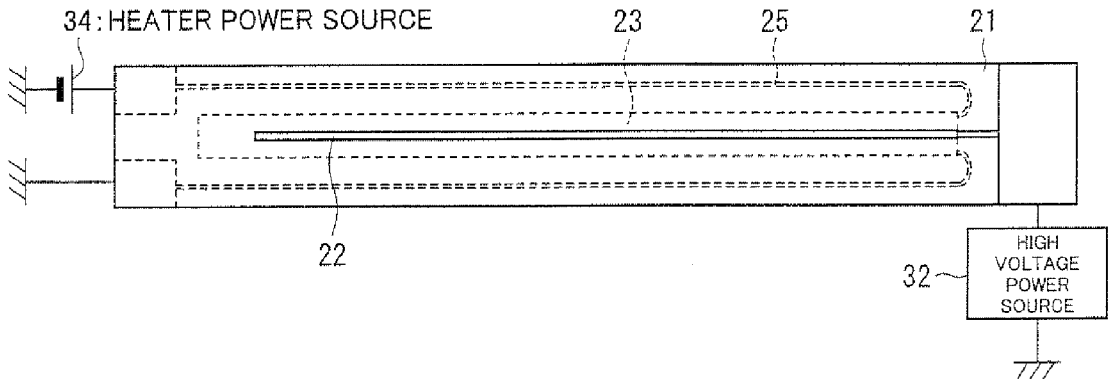

The heater electrode 25 may be wired as illustrated in FIG. 4(*c*), for example. Specifically, the heater electrode 25 may be wired in such a manner that the heater current flows into a ground electrode section from the heater power source 34 through an area where the heater electrode 25 and the inductive electrode 23 are connected with each other. In this case, in the inductive electrode 23, the heater current flows through only the area connected with a narrow heater line (right end of the inductive electrode 23 in FIG. 4(*c*)). The inductive electrode 23 has the same electric potential therein, so that the heater current does not flow in the inductive electrode 23. However, the inductive current is induced to flow into the inductive electrode 23 through the heater line by the alternating voltage which is applied to the discharge electrode 22. Consequently, in the arrangement as illustrated in FIG. 4(*c*), the inductive current comes and goes between the heater power source 34 side and the ground electrode side, so that there is a possibility of being influenced by noises. Thus, the arrangements illustrated in FIGS. 1(*a*) to 1(*c*) are more preferable.

It is preferable that the discharge electrode 22 and the inductive electrode 23 are plated with copper, gold, nickel or the like. The plating extends life duration as the electrodes and also increases strength of the electrodes.

The coating layer 24 is formed on the dielectric body 21 so as to cover the discharge electrode 22, by using, for example, alumina (aluminum oxide), glass, silicon, or the like.

A fabrication method of the ion generating element 1 is explained here. However, the fabrication method is not limited to the following method or numeral values. First, an alumina sheet having a thickness of 0.2 mm is cut to a predetermined size (for example, 8.5 mm in width×320 mm in length) and two alumina bases that have substantially the same size are formed. These alumina bases are used as the upper dielectric body 21*a* and the lower dielectric body 21*b*. Next, on an upper surface of the upper dielectric body 21*a*, tungsten is screen-printed in a comb-tooth shape as the discharge electrode 22 so that the discharge electrode 22 is integrally formed with the upper dielectric body 21*a*. On the other hand, as the heater electrode 25 and the inductive electrode 23, tungsten is screen-printed on an upper surface of the lower dielectric body 21*b* so that the heater electrode 25 and the inductive electrode 23 are formed to be integral with the lower dielectric body 21*b*. In the present embodiment, the inductive electrode 23 is printed in a center of the lower dielectric body 21*b* to be along a longitudinal direction of the lower dielectric body 21*b*, and the heater electrode 25 is printed in an U-shape to surround the inductive electrode 23 while passing near the periphery of the lower dielectric body 21*b*.

Further, the coating layer 24 made of alumina is formed on a surface of the upper dielectric body 21*a* so as to cover the discharge electrode 22. This forms insulation coating of the discharge electrode 22. After a lower surface of the upper dielectric body 21*a* and an upper surface of the lower dielectric body 21*b* are brought together so that the discharge electrode 22 and the inductive electrode 23 are opposed to each other via the upper dielectric body 21*a*, crimping is carried out. Then, the upper dielectric body 21*a* and the lower dielectric body 21*b* are put into a furnace and baked in a nonoxidized atmosphere at a temperature in a range of 1400° C. to 1600° C. The ion generating element 1 of the present embodiment can be easily fabricated in this way. Crimping of unbaked sheets may be performed before printing of the discharge electrode 22 or before/after formation of the coating layer 24. Moreover, the number of crimping may be determined as appropriate.

The counter electrode 31 of the present embodiment is a stainless steel plate. The counter electrode 31 is provided in a position that is opposed to the ion generating element 1 via the intermediate transfer belt 15 so that the counter electrode 31 touches a back surface (surface on a side where a toner image is not formed) of the intermediate transfer belt 15. The counter electrode 31 is connected to ground via the counter electrode power source 35.

The counter electrode power source 35 is arranged to apply a predetermined voltage to the counter electrode 31. This counter electrode power source 35 is provided to allow discharge from the discharge electrode 22 to occur more easily. The counter electrode power source 35 is not necessarily required, but is dispensable.

The high voltage power source (a voltage application circuit) 32 is arranged to apply a high alternating voltage between the discharge electrode 22 and inductive electrode 23 of the ion generating element 1, under control of a voltage controlling section 33. The high voltage power source 32 employs a pulse wave of an applied voltage Vpp of 2 kV to 4 kV, an offset bias Vdc of −1 kV to −2 kV, and a frequency f of 500 Hz to 2 kHz. A high-voltage-side-time duty of the pulse wave is arranged to be 10% to 50%. A waveform of the applied voltage may be a sine wave. However, a pulse wave is more preferable, in consideration of discharge efficiency and particularly discharge performance under a high humidity condition.

When an alternating high voltage is applied between the discharge electrode 22 and the inductive electrode 23 by operating the high voltage power source 32 with the above arrangement, creeping discharge (corona discharge) occurs in the vicinity of the discharge electrode 22 due to an electric potential difference between the discharge electrode 22 and the inductive electrode 23. This ionizes an atmosphere surrounding the discharge electrode 22 and generates negative ions. Consequently, a toner image on the intermediate transfer belt 15 is charged to a predetermined charging amount (here approximately −30 μC/g).

Further, the high voltage power source 32 is connected to the voltage controlling section 33. The voltage controlling section 33 controls an applied voltage level of the high voltage power source 32. Specifically, the voltage controlling section 33 measures a value of a current flowing in the counter electrode power source 35, and performs a feedback-control of a voltage applied by the high voltage power source 32 so that the measured value of the current is set to be a target value.

A value of a current that flows in the counter electrode 31 correlates with a discharge amount of the toner image. Therefore, when the current that flows in the counter electrode 31 is kept constantly at a target value, the discharge amount of the toner image is kept at a constant value.

Thus, according to amperes of the current flowing in the counter electrode 31, volts of the applied voltage of high power source 32 is feedback-controlled. Consequently, an appropriate amount of ions is supplied to the toner image all the time, even when a generation amount of ions or a ratio of the generated ions reaching the toner image varies according to (i) adherence of foreign matters to a tip of the discharge electrode 22, (ii) a change in surrounding conditions, (iii) a change of a wind in the image forming apparatus 100, and the like.

As described above, in the ion generating element 1 of the present embodiment included in the charging device (the first pre-transfer charging device 2, the second pre-transfer charging device 3 and the latent image charging device 4) of the present embodiment, the heater electrode 25 and the inductive electrode 23 are provided independently, and the heater current does not flow into the inductive electrode 23. Thereby, the resistance value of the inductive electrode 23 does not affect the heater electrode 25. This makes it possible to appropriately set a size or a shape of the inductive electrode 23, according to various conditions. Further, the heater electrode 25 can decrease absorption moisture by heating the ion generating element 1, without any influence on discharge characteristics between the discharge electrode 22 and the inductive electrode 23. Thus, the ion generating element 1 can discharge stably and effectively. Furthermore, in a case where the heater electrode 25 uses a voltage (e.g. 12V and 24V) that is also used for discharge for generating ions, it is possible to adjust a width and a length of the heater electrode 25 so that the ion generating element 1 receives a desired input power supply for the heating. Moreover, the heater electrode 25 and the inductive electrode 23 are formed on the same surface of the dielectric body 21, so that it becomes possible to form the ion generating element 1 without an increase in the thickness in a lamination direction toward the dielectric body 21. Thus, an increase in the size of the ion generating element 1 can be prevented. The following describes further effects of the ion generating element according to the present invention.

The effects by the ion generating element according to the present invention are explained below with reference to FIGS. 1(*b*), 1(*c*) and 5. Each of FIGS. 1(*b*) and 1(*c*) illustrates an arrangement of a modified example of the ion generating element 1 illustrated in FIG. 1(*a*). In the ion generating element 1' employing the arrangement illustrated in FIG. 1(*b*), and the ion generating element 1" employing the arrangement illustrated in FIG. 1(*c*), the inductive electrode 23 is provided to face the discharge electrode 22 with the dielectric body 21 therebetween, and one end of the inductive electrode 23 is directly connected to an electrode contact point which is to become the ground potential. The heater electrode 25 is formed as a line-shaped heater line, and is wired along the vicinity of the periphery area of the dielectric body 21. One end of the heater electrode 25 is connected to the heater power source 34, and the other end is connected to the ground potential. Due to this arrangement, the heater current does not flow into the inductive electrode 23. Further, the heater electrode 25 is wired in a position away from the discharge electrode 22, so that the inductive current hardly flows into the heater electrode 25. A width of the heater electrode 25 is 0.1 mm and its resistance value is approximately 30Ω in the ion generating elements 1' and 1". However, the width and the resistance value are not limited to these numeral values.

The inductive electrode 23 may be a plane electrode as illustrated in FIG. 1(*b*), or may have a line shape as illustrated in FIG. 1(*c*). Here, in the case of the plane electrode, the width is 1.5 mm, and in the case of the line-shaped electrode, the width is 1 mm, and their resistance values are in a range of approximately 1Ω to 2Ω. This resistance value is considerably smaller than that of the heater electrode 25. These numeral values are just examples, of course. The ion generating element employing this arrangement allows the inductive current to flow into the inductive electrode 23 area but hardly allows the inductive current to flow into the heater electrode 25.

Figure 5A:
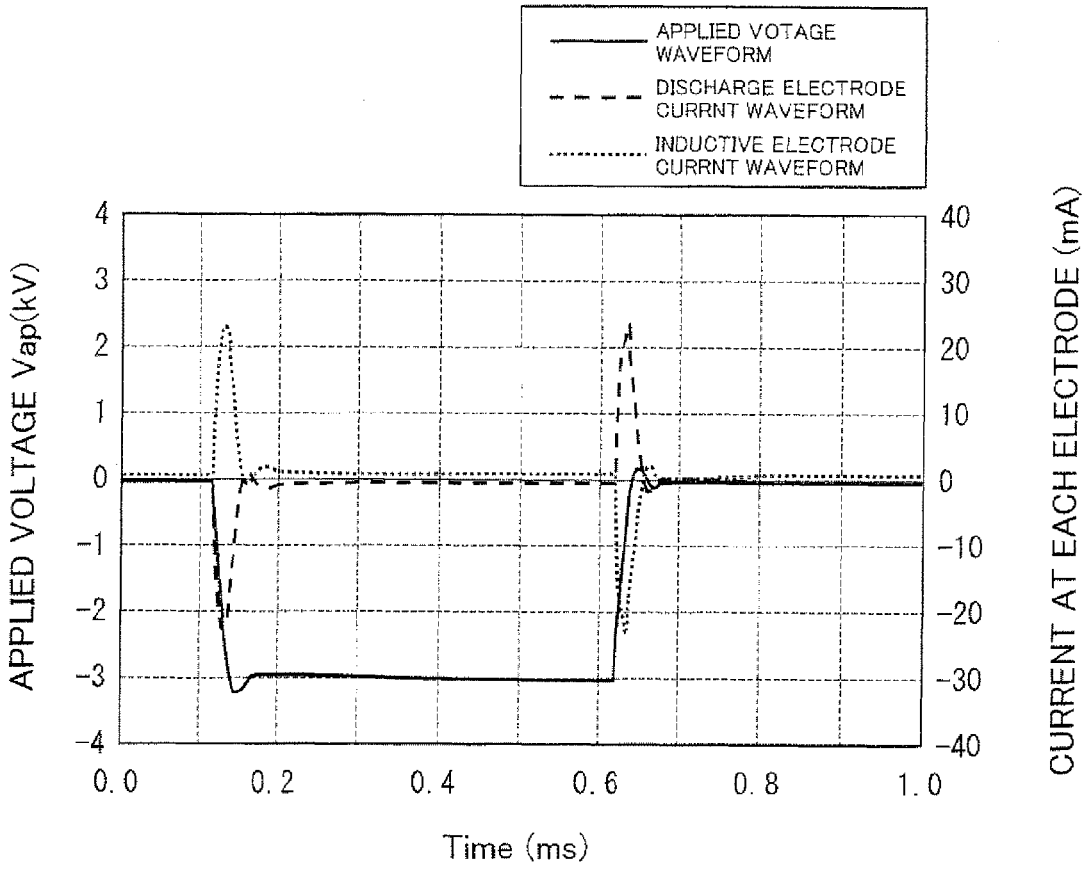
FIG. 5(*a*) is a view showing a result of measurement of an applied voltage waveform, and current waveforms at a discharge electrode and an inductive electrode while a pulse voltage is applied to the ion generating element.
Figure 5B:
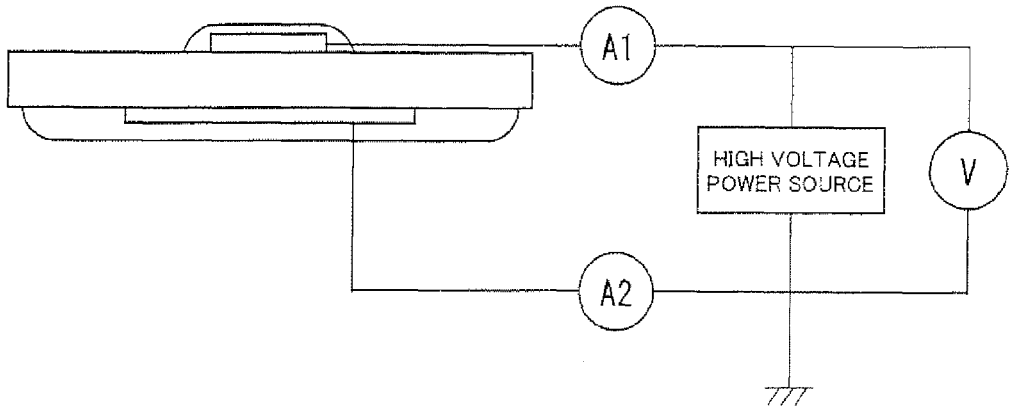
Figure 6:
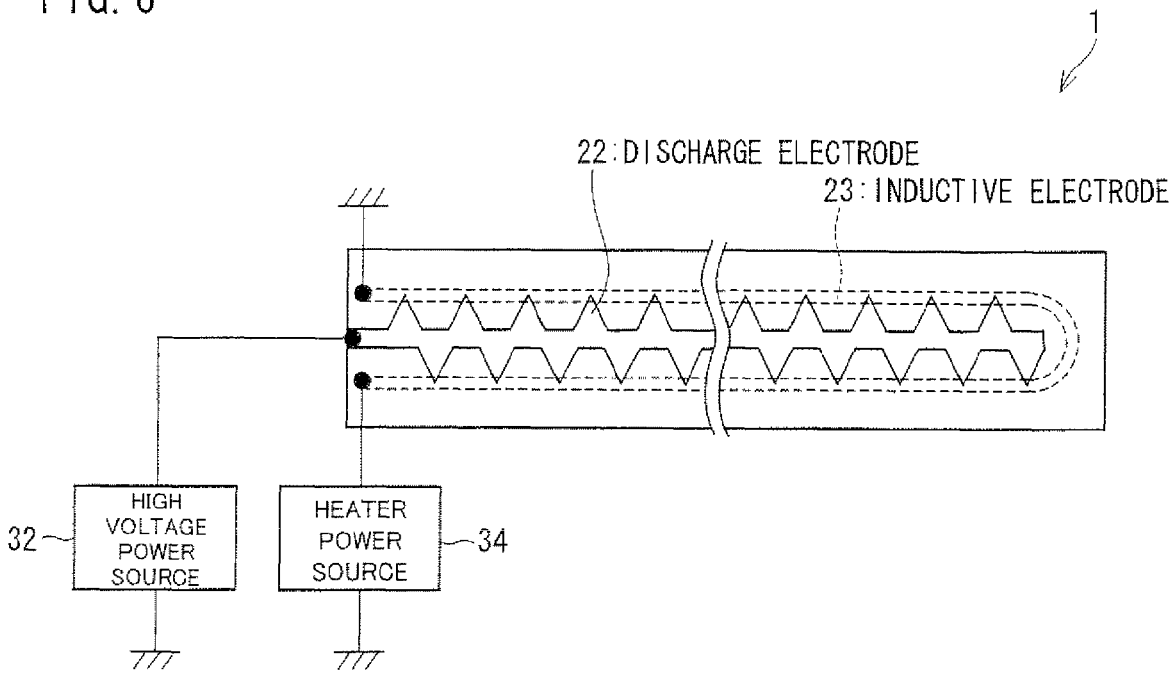
FIG. 6 is an elevational view of an example of a conventional ion generating element.

FIG. 5 illustrates a result of measurement of an applied voltage waveform and current waveforms at the discharge electrode and the inductive electrode, when a pulse voltage is applied to the ion generating element. The system of measurement is arranged as illustrated in FIG. 5(*b*). As illustrated in FIG. 5(*a*), when the voltage rises (in this case, when negative electricity increases), a current for charging a capacitor component between the discharge electrode and the inductive electrode flows at once, and a spike-like waveform is observed. This spike-like waveform includes a discharge current. After the voltage has risen, the current hardly flows since it is charging the capacitor component. However, when the voltage falls, a reverse current occurs.

When this inductive current flows into the heater power source section via the heater electrode, there may be occurrence of noises. However, in the present embodiment, the inductive electrode and the heater electrode are provided independently so that the inductive current is prevented from flowing into the heater power source section. This prevents occurrence of noises.

Here, in the high humidity environment, the pulse wave has higher discharge efficiency than the sine wave. This is because, in the high humidity environment, the potential difference between the discharge electrode and the dielectric body around the discharge electrode becomes small due to an influence of absorption moisture therebetween. In a case where the sine wave voltage is applied, a big potential difference hardly occurs depending on a time constant of surface resistance in the vicinity of the discharge electrode with respect to a rise time of the voltage, under moisture absorption condition. Thereby, discharge hardly occurs. In contrast thereto, in the case of the pulse wave, the applied voltage varies precipitously, so that it is easy to have a state where the potential difference between the discharge electrode and the dielectric body is large. Thereby, it becomes easy to generate discharge. However, in a case where the pulse voltage is applied, the inductive current has a spike-like shape, and the current value is large. This could cause noises. Not illustrated though, in a case where the sine-wave voltage is applied, the waveform at each of the electrodes has a sine-wave shape, and has a spike-like shape right before a peak of the voltage due to a discharge current. However, in a case where the sine-wave voltage is applied, the current value varies in a small range and the maximum current value and the spike-like current value are small. Therefore, although there is little influence of noises, the discharge performance becomes worse in the high humidity environment, as described above.

On the other hand, in the high humidity environment, it is effective to reduce absorption moisture by heating the discharge element with a heater. With both a heater effect and a pulse wave effect, it becomes possible to discharge more stably and effectively. However, in a case where the pulse voltage is applied, the inductive current is generated in the spike-like shape when the voltage rises and falls. When this inductive current flows in a heater power source line, this could easily cause damage to the heater power source and noises.

However, with the arrangement of the present embodiment, even if the pulse voltage is applied, a flow of the inductive current into the heater power source section is suppressed, so that damage to the heater power source or generation of noises is reduced. Thereby, it becomes possible to have both the heater effect and the pulse wave effect. Thus, it is possible to overcome the problem described above by employing the arrangement of the present embodiment.

Example

Next, the following explains an example of the ion generating element according to the present invention. Here, the example of the present invention and conventional ion generating elements as comparative examples are explained with reference to FIG. 4. FIGS. 4(*a*) and 4(*b*) are views illustrating the conventional ion generating elements as comparative examples, and FIG. 4(*c*) is a view illustrating the ion generating element in accordance with the present example.

In an ion generating element of Comparative Example 1, as illustrated in FIG. 4(*a*), an inductive electrode 23 is a plane electrode, and a bias voltage is applied to both ends of the inductive electrode 23 so that the inductive electrode 23 has a heater function. In short, in this Comparative Example 1, the inductive electrode 23 doubles as a heater. In Comparative Example 1, a width of the plane electrode is approximately 1.5 mm, and its length is approximately 300 mm, and a resistance value of the heater electrode is approximately 1.2Ω.

In an ion generating element of Comparative Example 2, as illustrated in FIG. 4(*b*), an inductive electrode 23 is looped to have a U shape, and a bias voltage is applied to both ends of the inductive electrode 23 so that the inductive electrode 23 has a heater function. That is to say, the inductive electrode 23 doubles as the heater in Comparative Example 2. In this Comparative Example 2, a width of the inductive electrode 23 is 1 mm, its length is approximately 600 mm, and a resistance value of the heater electrode is approximately 3Ω.

An ion generating element of Comparative Example 3 has the same shape as Comparative Example 2 illustrated in FIG. 4(*b*), and has the same arrangement as Comparative Example 2 except that a width of the electrode is 0.7 mm. The resistance value of the heater electrode is approximately 4.5Ω. In Comparative Example 3, the inductive electrode 23 doubles as the heater.

The ion generating element of the present example (Example 1), as illustrated in FIG. 4(*c*), has an arrangement in which an inductive electrode and a heater electrode are functionally separated. As the inductive electrode, a plane electrode is positioned directly below the vicinity of the discharge electrode, and a width of the plane electrode is 1.5 mm as in Comparative Example 1. Further, a resistance value of the inductive electrode is set to be in a range of approximately 1Ω to 2Ω. In the present embodiment, the heater electrode 25 is a heater line connected with the inductive electrode 23 which is the plane electrode, and one end of the heater line is connected with a connecting section on a heater power source 34 side, and the other end is connected with a connecting section on a ground potential side. As illustrated in FIG. 4(*c*), the heater electrode 25 is wired in such a manner that a heater current flows into a ground electrode section from the heater power supply 34 through an area where the heater electrode 25 and the inductive electrode 23 are connected with each other. Therefore, in the inductive electrode 23, the heater current flows through only the area (a right edge area illustrated in FIG. 4(*c*)) connected with a narrow heater line, and does not flow into the inductive electrode 23 because there is no potential difference in the inductive electrode 23. The following describes an inductive current in the present example illustrated in FIG. 4(*c*). An alternating voltage that is applied to the discharge electrode 22 induces a current to flow into the inductive electrode 23 through the heater line. In FIG. 4(*c*), the inductive current comes and goes between the heater power source 34 side and the ground electrode side. Consequently, there is a possibility of noise influence. In the present example, a width of the heater electrode was set to approximately 0.1 mm, and its resistance value was set to approximately 30Ω.

Here, the ion generating element of the present example has the arrangement illustrated in FIG. 4(*c*), so that the heater current hardly flows into the inductive electrode area. However, it is more preferable to have arrangements illustrated in FIGS. 1(*a*) to 1(*c*). This means an arrangement in which the main route for the inductive current to flow is a pathway from the ground electrode. With such an arrangement, the inductive current hardly flows to the heater power source through the heater line having high resistance, making the ion generating element more resistive to noises.

Example 1 and Comparative Examples 1 to 3 employ the same resistor and the same resistance rate. Thereby, there should be a proportional relation of the resistance value to the width and length of the electrode. However, in fact, this proportional relation is slightly shifted. This may be because in a case where an electrode is printed or pressed, a condition of the electrode may differ due to its shape, such as a plane shape and a line shape, resulting in a difference in a thickness or density of an electrode layer.

A discharge performance and a heating performance of the ion generating elements of Example 1 and Comparative Examples 1 to 3 were measured. The results are shown in the following table.

TABLE 1

| | RESISTANCE | INPUT POWER SUPPLY (5 V) | INPUT POWER SUPPLY (12 V) | HEATING | WIDTH OF INDUCTIVE ELECTRODE | AMOUNT OF IONS |
|---|---|---|---|---|---|---|
| COMPARATIVE EXAMPLE 1 | Approx. 1.2 Ω | Approx. 21 W | Approx. 120 W | Excessive | 1.5 mm | Appropriate |
| COMPARATIVE EXAMPLE 2 | Approx. 3 Ω | Approx. 8.3 W | Approx. 48 W | Excessive | 1 mm | Appropriate |
| COMPARATIVE EXAMPLE 3 | Approx. 5 Ω | Approx. 5 W | Approx. 32 W | Appropriate | 0.6 mm | Low |
| EXAMPLE 1 | Approx. 30 Ω | Approx. 0.8 W | Approx. 4.8 W | Appropriate | 0.1 mm | Appropriate |

In Table 1 the width 0.1 mm is the width of the heater electrode for Example 1. In all Comparative Examples, inductive electrodes also functioned as heaters. In order to reduce costs for a heater power source, a voltage to be applied to a heater electrode was set to 5V and 12V, which are general-purpose power source voltages in an image forming apparatus. Here, 24V is also a target voltage, but was not used in the measurement since usage of 24V would make the input power supply too large. Further, it is desirable that the ion generating element has a heating performance capable of heating up to a temperature that is higher by 20° C. to 30° C. than a room temperature. The heating in that range can remove absorption moisture on a surface of the ion generating element so as to improve discharge characteristics. Too much heating may result in bad effects in safety, or may result in bad effects in discharge characteristics due to fusion of adhered toner.

In Example 1 and Comparative Examples 1 to 3, a thickness of the dielectric body (a dielectric layer) between the discharge electrode and the inductive electrode is set to 0.2 mm, and a thickness of a ceramic layer formed on an inductive electrode side to protect and insulate the inductive electrode and to increase strength thereof is set to 0.7 mm. The whole thickness comes to approximately 0.9 mm. Such an ion generating element needs approximately 5 W of input power supply to be heated as described above. Whether heating performance was appropriate or not was evaluated depending on whether or not 5 W of the input power supply is achieved at the above applied voltage.

As shown in TABLE 1, under the condition of Comparative Example 1, it was possible to successfully ensure an ion generating ability with a sufficient width of the inductive electrode. However, a resistance value of the heater electrode was too low, and, the heating performance was achieved excessively when 5V or 12V was input. Further, in Comparative Example 2, the width of the inductive electrode was reduced to 1 mm, and it was possible to ensure a sufficient generation amount of ions. However, the resistance value was not appropriate, and the heating performance was achieved excessively. Furthermore, in Comparative Example 3, the width of the inductive electrode was further reduced to 0.6 mm, and the resistance value was set to approximately 5Ω, resulting in approximately 5 W of input power in response to application of 5V. This achieved appropriate heating performance. However, the ion generating ability dropped because of a narrow width of the inductive electrode. As such, in a case where the inductive electrode doubles as the heater electrode, it is difficult to set a condition that can achieve both the ion generating ability and the heater heating performance at low costs. Note that, not described above though, it may be possible to change a thickness or specific resistance of the inductive electrode (the heater line). However, in view of coating conditions, compatibility with a basic material for a dielectric body, and the like, it is not practically easy to set an arbitrary thickness or arbitrary specific resistance.

On the other hand, in Example 1 having the arrangement according to the present invention, a plane electrode is employed as the inductive electrode so as to ensure a required generation amount of ions. Simultaneously, the line-shaped heater electrode is set so as to have a width for allowing the resistance value to be optimum. Therefore, with the ion generating element having the arrangement according to the present invention, it becomes possible to easily have satisfactory characteristics in both the generation of ions and the heating performance.

As described above, the example ion generating element according to the present invention is an ion generating element for generating ions resulting from creeping discharge caused by applying an alternating voltage across a discharge electrode and an inductive electrode, both of which are provided to face each other with a dielectric body therebetween, including a heater electrode for heating the ion generating element with Joule heat generated by electrification, the heater electrode and inductive electrode provided independently on the same surface of the dielectric body, and the heater electrode and the inductive electrode being connected with each other and positioned such that a heater current does not flow into the inductive electrode.

Further, the ion generating element according to an aspect of the present invention is an ion generating element for generating ions resulting from creeping discharge caused by applying an alternating voltage across a discharge electrode and an inductive electrode, both of which are provided to face each other with a dielectric body therebetween, including a heater electrode for heating the ion generating element with Joule heat generated by electrification, the heater electrode and inductive electrode provided independently on the same surface of the dielectric body, and the heater electrode and the inductive electrode positioned such that a heater current does not flow into the inductive electrode.

In addition to the above arrangement, the ion generating element according to an aspect of the present invention may be arranged so that the heater electrode is positioned in such a manner as to surround the inductive electrode positioned to face the discharge electrode.

With this arrangement, it is possible to successfully and easily prevent the heater current from flowing into the inductive electrode so that an inductive current flows into the inductive electrode. This makes it possible to cause the inductive current to hardly flow into the heater electrode. For example, the ion generating element may be arranged so that the discharge electrode and the inductive electrode are provided to face each other with the dielectric body having a plate shape therebetween, and the heater electrode is positioned along the vicinity of a periphery area of the dielectric body.

In addition to the above arrangements, the ion generating element according to an aspect of the present invention may be arranged so that the inductive electrode includes a ground connecting section, and one end of the heater electrode is connected with a ground potential, and the other end of the heater electrode is connected with a heater power source.

When the alternating voltage is applied across the discharge electrode and the inductive electrode, an alternating current for charging/discharging a capacitor component formed by both the electrodes and a dielectric layer therebetween flows. This alternating current is generated both at a discharge electrode side and an inductive electrode side. Here, it is not preferable that the inductive electrode is connected with the heater electrode, because there is a possibility that the inductive current affects a heater power source section as noises. However, as in the example arrangement according to the present invention, with the ground connecting section, it is possible to directly connect the inductive electrode with the ground potential by using the ground connecting section. Thereby, noise hardly enters a heater power source line.

Further, in addition to the above arrangements, the ion generating element according to an aspect of the present invention may be arranged so that the inductive electrode is not connected with the ground potential, and the heater electrode has a line shape, further, one end of the heater electrode is connected with the ground connecting section, and the other end of the heater electrode is connected with the heater power source.

With this arrangement, the inductive current flows to the ground connecting section in such a manner that noises hardly enter the heater power source line. Therefore, the arrangement is preferable.

In addition to the above arrangements, the ion generating element according to an aspect of the present invention may be arranged so that the heater electrode has a line shape, and a resistance value of the inductive electrode is smaller than that of the heater electrode.

With this arrangement, almost all the inductive current flows toward a ground electrode. Thus, components of the inductive current that flows through the heater line decreases, reducing noises given to the heater power source line.

A charging device according to an aspect of the present invention includes any of the above ion generating elements, and a power source section for applying an alternating voltage across the discharge electrode and the inductive element.

With this arrangement, the charging device includes any of the above ion generating elements, so that it is possible to provide a compact charging device that can discharge stably and effectively.

In addition to the above arrangement, the charging device according to an aspect of the present invention may be arranged so that a waveform of the alternating voltage applied by the power source section is a pulse wave.

Particularly in a high humidity environment, a pulse waveform has higher discharge efficiency. This is because under the high humidity condition, a potential difference between the discharge electrode and the dielectric body therearound is small due to an influence of absorption moisture therebetween. In a case where the sine-wave voltage is applied, a large potential difference hardly occurs depending on a time constant of surface resistance in the vicinity of the discharge electrode with respect to a rise time of the voltage, under moisture absorption condition. On the other hand, in the case of the pulse voltage, the applied voltage varies precipitously. Therefore, it is easy to achieve a state in which a potential difference between the discharge electrode and the dielectric body is large. Consequently, discharge is easily produced. Further, in the high humidity environment, it is effective to reduce absorption moisture by heating the discharge element with a heater, and with both a heater effect and a pulse wave effect, it is possible to discharge more stably and effectively. However, in a case where the pulse voltage is applied, the inductive current has a spike-like waveform when the voltage rises and falls. Thus, when the inductive current flows in the heater power line, damage to the heater power source, or noise is likely to be generated.

With the arrangements of the present invention, i.e., with the use of both (i) an arrangement in which the inductive electrode is directly connected with the ground electrode so that the inductive current hardly flows into the heater electrode, and (ii) application of the pulse voltage, it is possible to provide the charging device that can generate ions further more effectively and stably.

An image forming apparatus according to an aspect of the present invention includes the charging device as a charging device for charging an electrostatic latent image bearing member.

With the use of the charging device according to an aspect of the present invention as the charging device for charging the electrostatic latent image bearing member, it is possible to appropriately charge the electrostatic latent image bearing member, and provide a compact image forming apparatus.

The image forming apparatus according to an aspect of the present invention includes the charging device as a pre-transfer charging device for giving electric charge to toner on a bearing member.

With the charging device according to an aspect of the present invention, it is possible to preferably and appropriately charge toner that has not been transferred yet, and also have an improvement in transfer efficiency and transfer uniformity. Further, the charging device according to the present invention is compact as described above. Consequently, it is possible to charge the toner that has not been transferred yet in a narrow space, making the image forming apparatus small in size.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below. Further, the present invention obviously includes modifications outside the scope of numeral values showed in this Specification as long as the modification does not change essential characteristics of the present invention.

Note that the present invention can be used as a charging device of an image forming apparatus employing an electrophotographic process, the charging device for (i) pre-transfer charge for charging a toner image that has not been transferred yet, formed on an image bearing member such as a photoreceptor and an intermediate transfer body, (ii) latent-image charge for charging the photoreceptor, and (iii) auxiliary charge for helping charging toner in a developing device.

What is claimed is:

1. An ion generating element for generating ions resulting from creeping discharge caused by applying an alternating voltage across a discharge electrode and an inductive electrode, both of which are provided to face each other with a dielectric body therebetween, comprising:

a heater electrode structured to heat the ion generating element with Joule heat generated by electrification, wherein the heater electrode and the inductive electrode are provided independently on a same surface of the dielectric body, and wherein the heater electrode and the inductive electrode being connected with each other by a common ground connecting section and positioned such that a heater current does not flow into the inductive electrode.

2. The ion generating element according to claim 1, wherein the heater electrode is positioned in such a manner as to surround the inductive electrode positioned to face the discharge electrode.

3. The ion generating element according to claim 1, wherein one end of the heater electrode is connected with the common ground connecting section, and the other end of the heater electrode is connected with a heater power source.

4. The ion generating element according to claim 1, wherein the heater electrode has a line shape, and a resistance value of the inductive electrode is smaller than that of the heater electrode.

5. A charging device comprising:

an ion generating element according to claim 1; and a power source section for applying an alternating voltage across the discharge electrode and the inductive electrode.

6. The charging device according to claim 5, wherein a waveform of the alternating voltage applied by the power source section is a pulse wave.

7. An image forming apparatus comprising:

a charging device according to claim 5 as a charging device for charging an electrostatic latent image bearing member.

8. An image forming apparatus comprising:

a charging device according to claim 5 as a pre-transfer charging device for giving electric charge to toner on an image bearing member.

9. An ion generating element for a charging device of an image forming apparatus, said ion generating element comprising:

a dielectric body;

a discharge electrode formed on and/or in said dielectric body such that at least a portion of said discharge electrode is above an upper surface of said dielectric body, said discharge electrode structured to be connectable to a high voltage power source;

an inductive electrode formed in said dielectric body below said discharge electrode and positioned to be substantially inductively coupled to said discharge electrode so as to generate ions through creeping discharge when said high voltage power source applies a time varying voltage to said discharge electrode, said inductive electrode structured to be connectable to a common potential source; and a heater electrode formed in said dielectric body separately from said inductive electrode and positioned to be substantially decoupled with said discharge electrode, said heater electrode being structured to be connectable to a heater power source at one end and connectable to said common potential source at other end so as to generate heat when current provided by said heater power source flows through said heater electrode, wherein when said inductive electrode and said heater electrode are connected to said common potential source, said heater electrode is structured to substantially resist induced current flowing through said inductive electrode from flowing into said heater electrode.

10. The ion generating element according to claim 9, wherein a resistance of said heater electrode is greater than a resistance of said inductive electrode.

11. The ion generating element according to claim 9, an insulation resistance between said discharge electrode and said inductive electrode is substantially uniform.

12. The ion generating element according to claim 9, wherein said inductive electrode is positioned to maximally overlap with said discharge electrode, and wherein said heater electrode surrounds said inductive electrode such that there is substantially no overlap between said discharge electrode and said heater electrode.

13. The ion generating element according to claim 9, further comprising a coating layer formed over said dielectric body and said discharge electrode such that said discharge electrode is surrounded substantially on all sides by said coating layer and said dielectric body.

14. The ion generating element according to claim 9, wherein said heating electrode and/or said inductive electrode are surrounded substantially on all sides by said dielectric body.

15. The ion generating element according to claim 9, wherein said common potential source is ground.

16. A charging device for an image forming apparatus, comprising:

an ion generating element according to claim 9 in which said other end of said heater electrode and said inductive electrode are connected to said common potential source;

a heater power source with one terminal connected to said one end of said heater electrode and other terminal connected to said common potential source; and a high voltage power source with one terminal connected to said discharge electrode and other terminal connected to said common potential source.

17. The charging device for an image forming apparatus according to claim 16, further comprising:

a counter electrode spaced apart by a predetermined distance from said discharge electrode and structured to control discharge from said discharge electrode.

18. The charging device for an image forming apparatus according to claim 17, further comprising:

a counter electrode power source structured to apply a voltage to said counter electrode such that current flowing through said counter electrode is substantially maintained at a target current value.

19. An image forming apparatus, comprising:

a latent charging device structured to charge a photosensitive drum;

a first pre-transfer charging device structured to charge toner on said photosensitive drum; and a second pre-transfer charging device structured to re-charge toner on a transfer belt, wherein a charging device according to claim 16 is used for any one or more of said latent image charging device, said first pre-transfer charging device, and second pre-transfer charging device.

20. An image forming apparatus, comprising:

a pre-transfer charging device according to claim 17 structured to recharge toner on a transfer belt, wherein said transfer belt is positioned in said space between said discharge electrode and said counter electrode such that said discharge electrode faces a side of said transfer belt with said toner.

* * * * *